US006381911B1

(12) United States Patent
Weiland

(10) Patent No.: US 6,381,911 B1
(45) Date of Patent: May 7, 2002

(54) DOOR JAMB SYSTEM

(76) Inventor: William Weiland, 2042 Sheridan, Encinitas, CA (US) 92024

( * ) Notice: Subject to any disclaimer, the term of this patent is extended or adjusted under 35 U.S.C. 154(b) by 0 days.

(21) Appl. No.: 09/641,823

(22) Filed: Aug. 17, 2000

(51) Int. Cl.[7] ..... E06B 1/04

(52) U.S. Cl. ..... 52/215; 52/204.54; 52/204.595; 52/204.67; 52/204.69; 52/204.7; 52/476

(58) Field of Search ..... 52/238.1, 242, 52/204.53, 204.6, 204.7, 717.01, 476, 211–217, 204.54, 204.69, 204.67, 204.595

(56) References Cited

U.S. PATENT DOCUMENTS 6,141,925 A * 11/2000 Halvorson, Jr. et al. ... 52/238.1

* cited by examiner

*Primary Examiner*—Carl D. Friedman
*Assistant Examiner*—Yvonne M. Horton

(74) *Attorney, Agent, or Firm*—John J. Murphey

(57) ABSTRACT

A jamb system for framing panels, in which at least one of the panels is arranged to slide by another panel along a set of tracks, including an elongated top jamb including one elongated top guide member for each panel, each member including an elongated rail for guiding a panel along its travel within the jamb, and a key spacer member, the top guide members and the key members each adapted to interlock through their respective walls to form a rectilinear assembly, including slanted wall portions arranged to mate in adjacent juxtaposition with each other to accept a threaded fastener therethrough and an elongated side jamb for each panel, and an elongated key spacer member for insertion between each pair of the elongated side members allowing the panels to move along the rails within the jamb, past each other, adapted to interlock through their respective walls, the side members and the key members including slanted wall portions arranged to mate and accept a threaded fastener there through to hold the side jamb in fixed, straight alignment.

25 Claims, 6 Drawing Sheets

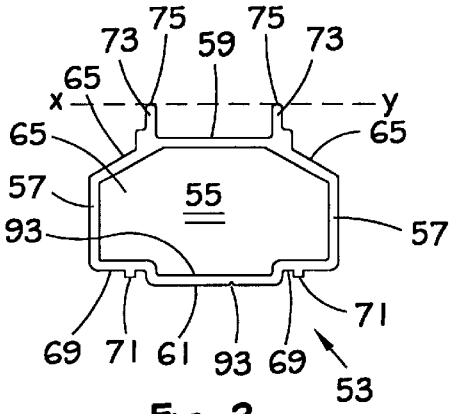
Fig. 3
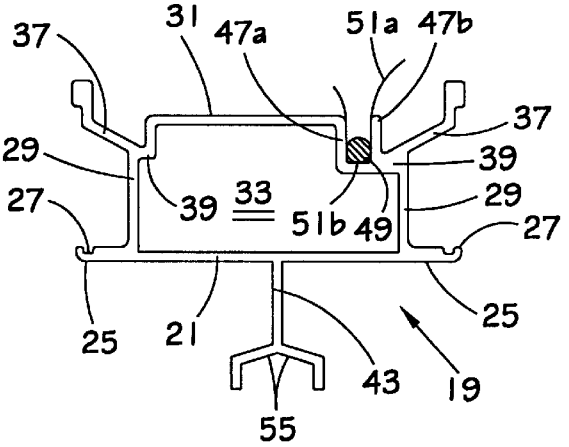
Fig. 2
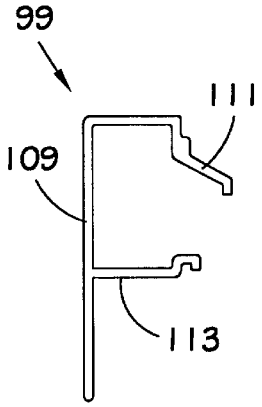
Fig. 6
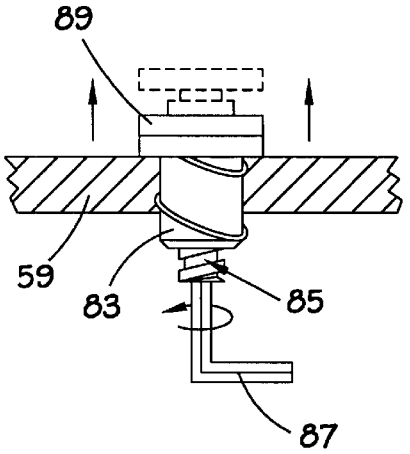
Fig. 4
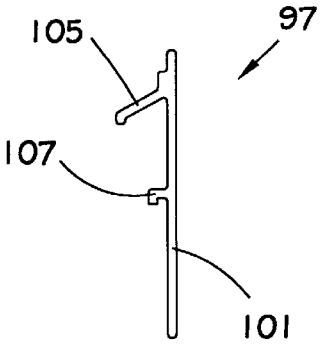
Fig. 5
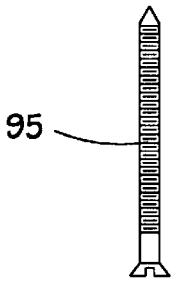

DOOR JAMB SYSTEM

BACKGROUND OF THE INVENTION

1. Field of the Invention

This invention pertains to the field of door and panel jamb systems. More particularly, the invention concerns a novel clip-together jamb system that may be altered to fit a wide variety of door-panel combinations heretofore existing.

2. Description of the Prior Art

A jamb is defined in the dictionary as a side post or a piece of a framed opening as for a door, window or fireplace. Historically, jambs are built on the job site, i.e., they are made of wood or poured concrete and are designed and later built in place so that they become an integral part of the structure with which they are assembled. This is all well and good for the workman, whose abilities are instrumental with designing and installing pieces of wood and frames in which concrete is poured, however, the method possesses two distinct disadvantages: it is time-consuming and thus very expensive, and concrete is heavy while wood distorts under load. Concrete, if used in elevated locations and in large enough quantity, will, without a very substantial base placed under it, slowly cause part of the structure to sag and distort the frame such that the panels will "hang-up" and become hard to move. On the other hand, wood often is singularly bendable so that, should one of the panels be moved roughly and strike the side frame member, the frame will often distort and make further panel moving difficult. Further, on-site constructed frames take a substantial amount of design, time and materials and are thus very expensive. They cannot be easily adjusted or moved without a significant effort.

Recent trends in home, office and entertainment construction include partial and whole wall sections being made from a plurality of panels that can be moved on tracks to increase or decrease the size of the room. What is needed therefore is a jamb system that is portable, amenable to a variety of designs, and capable of numerous configurations, along the top and the sides of the frame, in order to allow assembly off the premises and simple erection on the premises to lower the cost of the entire process. Further, the jamb system should be strong enough to withstand movement of the door panels, that may each weigh up to many hundreds of pounds, and is capable of adjustment for misalignment caused by settling of the overall structure or movement caused by earth temblors, or other reasons.

SUMMARY OF THE INVENTION

This invention is a novel jamb system for framing a plurality of panels, in which at least one said panel is arranged to slide by another said panel along a set of parallel tracks mounted on a supporting surface, comprising an elongated top jamb of defined width and terminated by spaced-apart inner and outer distal ends, the jamb including one elongated top guide member for each panel, each member including an elongated rail depending therefrom for guiding a panel along its travel within the jamb, and an elongated key spacer member for insertion between each pair of top guide members for spacing the adjacent top guide members apart a distance allowing the panels to move along the rails within the jamb past each other without interference, the top guide members and the key members each formed of a plurality of side, top and bottom walls and including bent portions adapted to interlock with other bent portions in their respective walls to form a rectilinear assembly of a plurality of members for topping a plurality of doors and panels, the top guide members and the key members including slanted wall portions arranged to mate in adjacent juxtaposition with each other and accept a threaded fastener therethrough and below the outer edges of the jamb to hold the jamb in fixed, straight alignment, and an elongated side jamb of defined width and terminated by spaced-apart inner and outer distal ends, the jamb including one elongated side member for each panel, and an elongated key spacer member for insertion between each pair of elongated side members for spacing the side members apart a distance allowing the panels to move along the rails within the jamb past each other without interference, the elongated side members and the key members each formed of a plurality of side, top and bottom walls and including bent portions adapted to interlock through their respective walls to form a rectilinear assembly of a plurality of members for abutting a plurality of doors and panels, the side members and key members including slanted wall portions arranged to mate in adjacent juxtaposition with each other to accept a threaded fastener there through to hold the side jamb in fixed, straight alignment, the elongated top jamb and elongated side jamb joined together to form a complete frame about the top and sides of the panels.

The frame of this invention can be fabricated off-site to handle an unlimited number of panels, notwithstanding whether some of them are fixed in position and others set in sliding position. The individual members are preferably made of extruded aluminum that fit together in twos, threes and so on, to frame a wide variety and number of panels.

Accordingly, the main object of this invention is a relatively low-cost approach to the manufacture and installation of frames for one or more panels, usually in multiples of panels wherein they are arranged and adapted to slide past one another without interference. Other objects of this invention include a frame that is lightweight, due to its hollow extruded nature, yet highly strong and fully able to withstand insults, such as having one or more panels collide with the side frames, wind forces, and the like; a frame that is easy to assemble in doubles, triples, and the like to handle a multiplicity of panels quietly and without undue stress being placed on the frame and the surrounding structure; a frame that may be easily and quickly shimmed and otherwise adjusted to retain its correct position in the structure yet remain able to be later adjusted due to forces from the rest of the structure that operate on the interface with the frame; and a frame that can be erected by semi-skilled labor and not require the higher cost of expert labor that normally is required to construct on-site frames.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE DRAWINGS

FIG. 2 is a cross-sectional view of a typical top guide member used in the top jamb section according to the teachings of this invention;

FIG. 3 is a cross-sectional view of a typical top key member used in the top jamb section according to the teachings of this invention;

FIG. 4 is a cross-sectional view of a typical adjustable shim used in the top or side jamb section according to the teachings of this invention;

FIG. 5 is a cross-sectional view of a typical interior fascia member used in the top jamb section according to the teachings of this invention;

FIG. 6 is a cross-sectional view of a typical exterior fascia member used in the top jamb section according to the teachings of this invention;

DESCRIPTION OF THE PREFERRED EMBODIMENT

Figure 1:
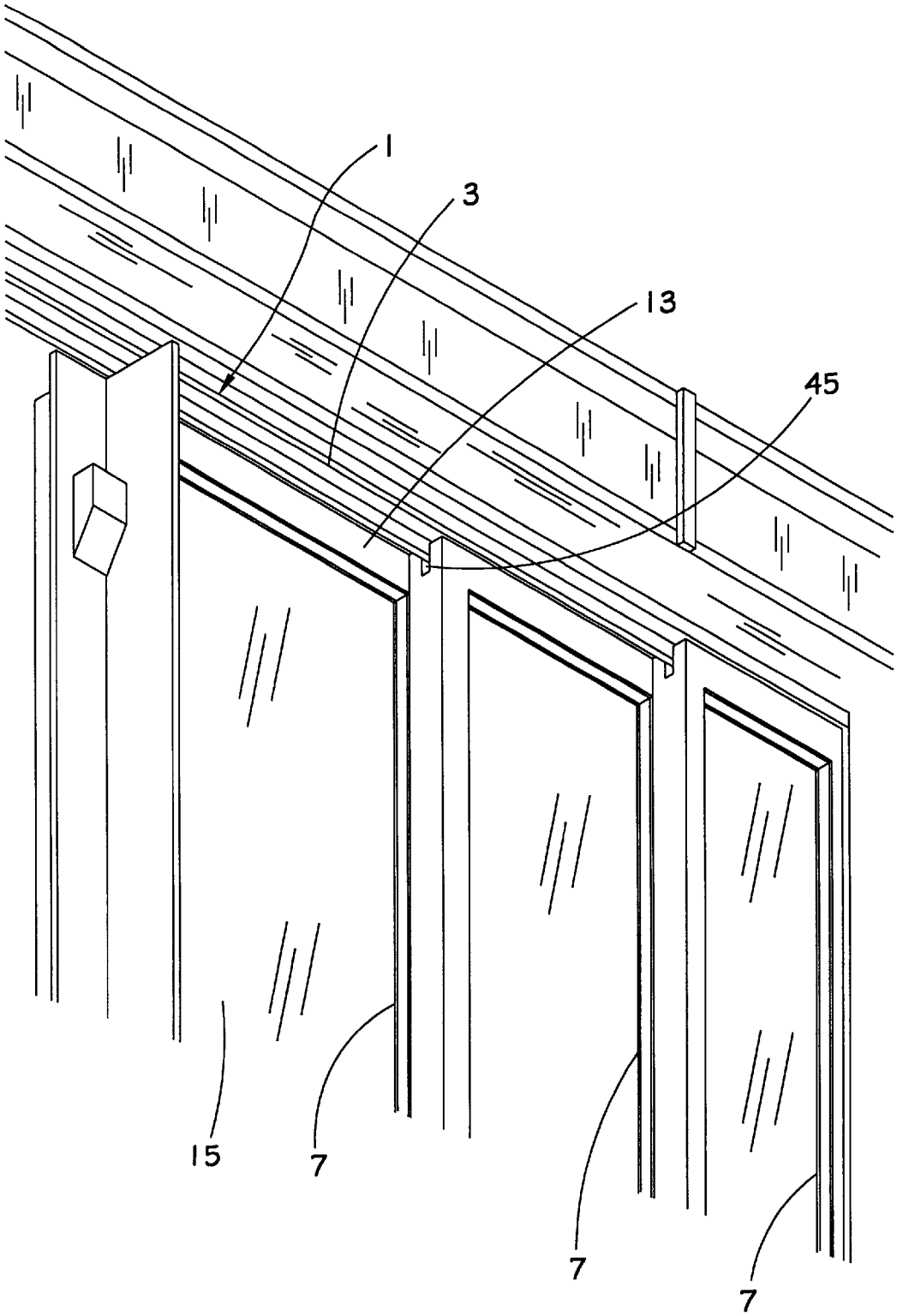
FIG. 1 is a perspective view of the top of a jamb system according to the teachings of this invention showing a plurality of panels located therein.

Turning now to the drawings wherein elements are identified by numbers and like elements are identified by like numbers throughout the seventeen figures, the invention 1 is generally depicted in FIGS. 1, and 12–15 as a novel jamb system, comprising an assembled top frame element 3 and a side frame element 5 for framing a plurality of panels 7, in which at least one panel has its own separate frame 13 and its own glass sub-panel 15 (see FIG. 7), is arranged on a track mounted on a supporting surface (not shown) to slide by another panel 7 without interference.

Figure 13:
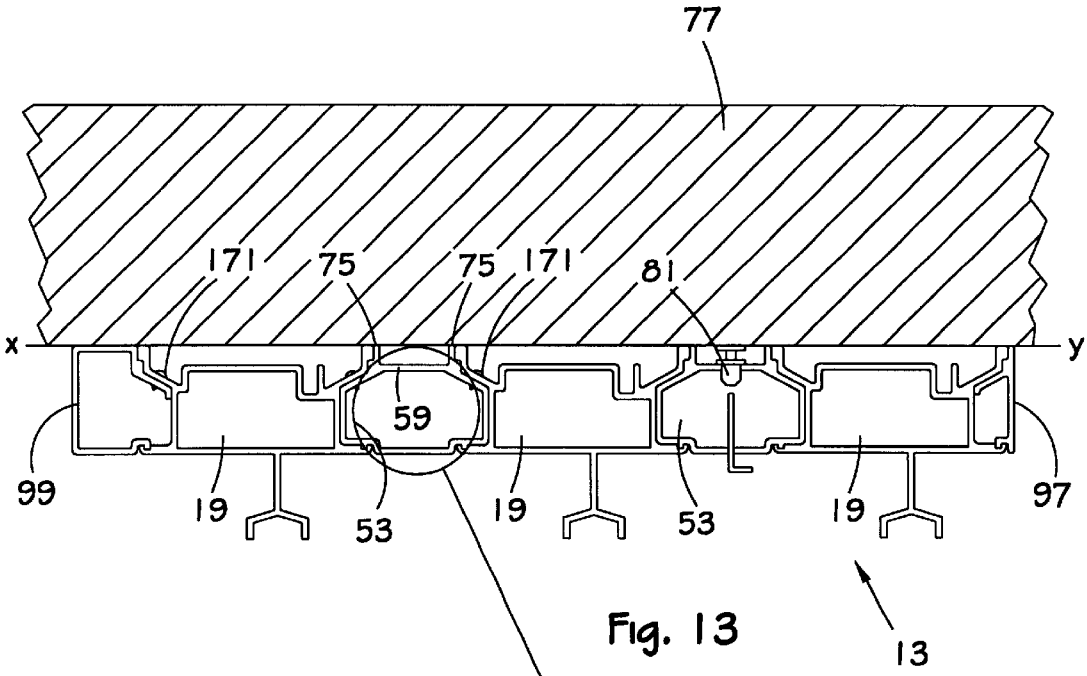
FIG. 13 is a cross-section view of a typical side jamb section.
Figure 13A:
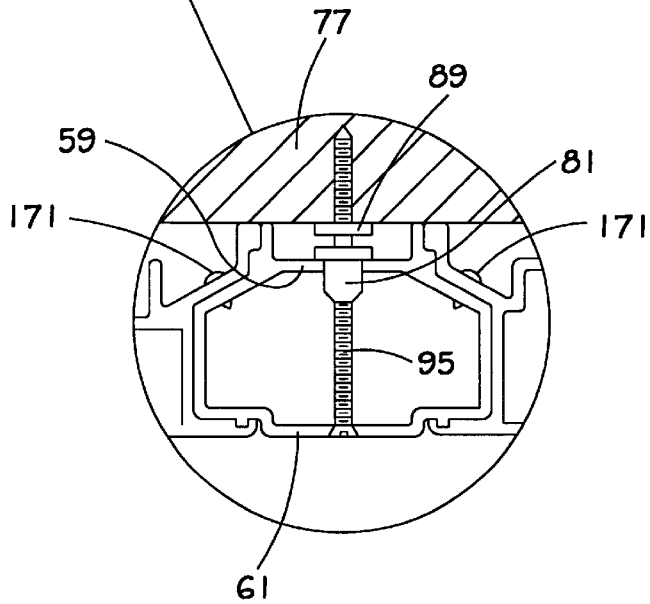
FIG. 13*a* is a close-up view of part of the jamb section shown in FIG. 13.
Figure 15:
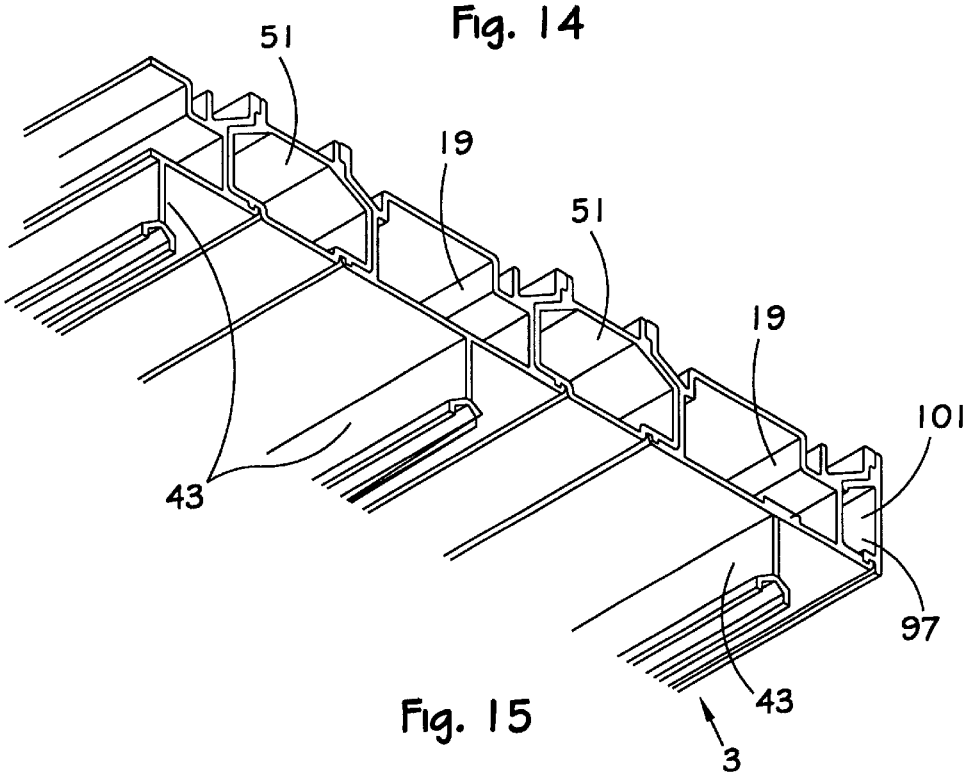
FIG. 15 is a perspective view of a typical top jamb section.

Assembled top frame element 3 is comprised of a plurality of separate members, each extruded from aluminum for lightness and strength, assembled together to form a strong jamb as shown in FIGS. 13 and 15. One such separate member is an elongated extruded, hollow top guide member 19 and is shown in FIG. 2 to comprise a thin, planar bottom wall 21 terminated by spaced-apart bottom wall edges 25 wherein said bottom wall edges are parallel and formed into a turned-out interlocking terminus 27. A pair of spaced-apart thin side walls 29 extend upward from bottom wall 21 in parallel arrangement and interior of, or inside, bottom wall turned-out wall edges interlocking terminus 27 and are preferably orthogonal to bottom wall 21. A top wall 31 is located parallel to bottom wall 21 and is spaced-apart thereabove and closes over top guide member 19 between side walls 29 to form a hollow interior 33. A pair of slanted walls 37 extend upward and outward from an area 39 on member 19 between top wall 31 and its junction with side walls 29. Slanted walls 37 terminate in a bent-outward-upward configuration. An elongated rail 43 depends from planar bottom wall 21, exterior hollow interior 33, and extends parallel to side walls 29, but in the opposite direction, for receipt in a groove 45 formed in the top of panels 7 (see FIG. 1) for guiding a panel along its travel within jamb 1. Rail 43 preferably is terminated along its bottom edge with a bifurcation 55 that fits in groove 45 (see FIG. 1).

A pair of closely spaced-apart wall members, 47*a* and 47*b,* are formed in a depression 49 formed in top wall 31 and preferably extend vertically upward a distance terminating slightly below the upper edge of slanted walls 37. Modern construction techniques often call for the use of a thin sheet or sheets of waterproof material 51*a* to be used to wrap. portions of the structure (home, office building etc.) to seal out rain, snow, and other elements. Wall members 47*a* and 47*b* form a narrow, deep groove therebetween and this is used to insert a loop of the edge of such wrapping material 51*a* therein followed by the insertion of a length of a larger-diameter "rope" of rubberized material 51*b,* called a "spline ", to jam in the groove and hold the loop in the groove thus allowing the sealing features of the wrap to extend along the entire length of the jamb.

As shown in FIG. 13, spaced between successive top guide members 19 are separate elongated key spacer members 53, shown in more detail in FIG. 3, to comprise a hollow central body 55 defined by a pair of thin, spaced-apart side walls 57, a top wall 59 and a bottom wall 61 enclosed to form a hollow interior. The upper portions of side walls 57 are formed into a pair of converging slanted walls 65 while the side portions of bottom wall 61 are indented slightly at 69, and each indentation is provided with a downwardly depending stub 71. Along top wall 59 arise two spaced-apart ears 73 that extend upward a short distance and terminate in edges 75 lying in a common plane x-y that abuts or mates with the outer (bottom) surface of a beam 77 set above the jamb for the purpose of providing support (see FIG. 13).

Top wall 59, between ears 73, is made of a thickness sufficient for receipt therein of an adjustable shim 81 that is used to adjust the distance of top guide member 19 from beam 77. Adjustable shim 81 is shown in FIG. 4 to comprise a cylindrical, hollow shim body 83 having one or more spiral threads formed exterior the body for threaded receipt in an aperture formed in top wall 59. A hollow plug 85 is received in hollow shim body 83 and is turnable on another set of exterior threads, in the opposite direction, formed thereon. The hollow opening in plug 85 is formed with adjacent flat wall sections (not shown) that allow the temporary insertion and acceptance of an Allen wrench 87 for turning plug 85 to raise or lower the overhead platform 89, via the threads, said platform formed on top of plug 85, against overlying beam 77 to shim the assembled jamb upward or downward vis-a-vis beam 77 (see also FIG. 13).

Bottom wall 61, located below top wall 59 has a small indentation 93 formed therein for locating a drill bit and for having an aperture drilled therein for insertion of Allen wrench 87. After use of Allen wrench 87 to adjust the assembled jamb against beam 77, wrench 87 is removed and an elongated fastener, such as a long screw 95, is inserted through the aperture and up through hollow plug 85 and into beam 77 for fastening the assembled jamb to said beam. Preferably, the head of screw 95 is flat so that it can be mounted flush with the exposed, underside of bottom wall 61. Adjustable shim 81 may also be located in top guide member 19.

Elongated, assembled top frame element 3 is terminated at both ends by separate inner and outer distal ends, 97 and 99 respectively as shown in FIGS. 13 and 15. These end members are also known as "fascia" members as they are the members most likely seen by anyone looking at the jambs from inside and outside the structure respectively. Inner fascia member 97 is shown in FIG. 5 to comprise an extrusion forming a flat, vertically-oriented, main interior fascia plate 101 having at least one slanted wall portion 105, extending away from plate 101 and adapted to abut against slanted wall 37 of top guide member 19, and another element 107, spaced-apart from slanted wall portion 105 and extending outward for connection with interlocking terminus 27 on top guide member 19. Main interior fascia plate 101 extends downward over elongated, assembled top frame element 3 to provide a cover for the upper edges of panels 7.

Outer fascia member 99 is shown in FIG. 6 to comprise an extrusion forming a flat, vertically-oriented, main, interior fascia plate 109 having at least one slanted wall portion 111, extending away from plate 109 and adapted to abut against slanted wall 37 of top guide member 19, and another element 113, spaced-apart from slanted wall portion 111 and extending outward for connection with interlocking terminus 27 on top guide member 19. Main exterior fascia plate 101 extends downward over elongated, assembled top frame element 3 to also provide a cover for the upper edges of panels 7.

Figure 7:
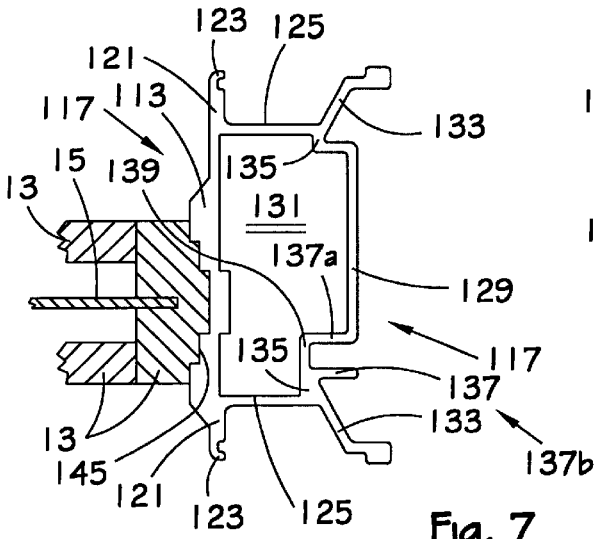
FIG. 7 is a cross-sectional view of one side member used in the side jamb section with a segment of a panel abutted thereagainst.
Figure 12:
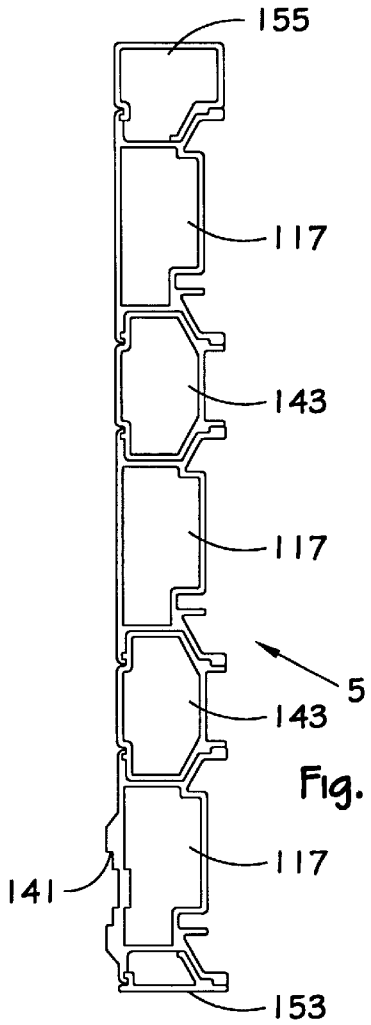
FIG. 12 is a cross-sectional view of a typical assembled top jamb section.
Figure 14:
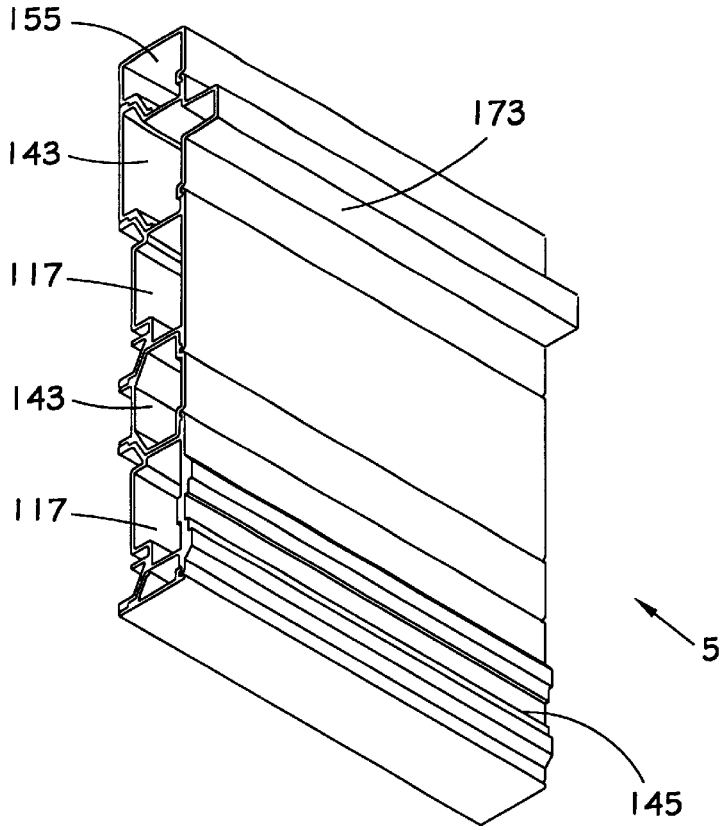
FIG. 14 is a perspective view of a typical side jamb section.

Assembled side frame element 5 is comprised of a plurality of separate members, each extruded from aluminum for lightness and strength, assembled together to form a strong jamb as shown in FIGS. 12 and 14. One such separate member is an elongated extruded, hollow side-guide member 117 and is shown in FIG. 7 to comprise a thick, front wall 119 terminated by spaced-apart side wall edges 121 wherein said side wall edges are parallel and formed into a turned-out interlocking terminus 123. Note that, while the top assembled jamb is described in terms of "bottom" walls (adjacent panels 7), and "top" walls (adjacent beam 77), side frame element 5 is described in terms of "front walls" to denote the wall (front) that faces or engages the side frame portion of panels 7 and "rear walls" to denote the wall (side) that faces away from the side frame portion of panels 7. A pair of spaced-apart thin side walls 125 extend rearward from front wall 119 in parallel arrangement and interior of, or inside, side wall turned-out wall edges interlocking terminus 123 and are preferably orthogonal to front wall 119. A rear wall 129 is located parallel to front wall 119 and is spaced-apart therefrom to close over side guide member 117, between side walls 121 to form a hollow interior 131. A pair of slanted walls 133 extend rearward and outward from an area 135 on member 117 between front wall 119 and its junction with rear walls 129. Slanted walls 133 terminate in a bent-outward-rearward configuration.

A pair of closely spaced-apart wall members, 137*a* and 137*b*, are formed in a depression 141 formed in rear wall 129 and preferably extend vertically rearward a distance terminating slightly inside the outer edge of slanted walls 133. As stated earlier, modern construction techniques often call for the use of a thin sheet or sheets of waterproof material 51*a* to be used to wrap portions of the structure (home, office building and the like) to seal out rain, snow, etc. Wall members 137*a* and 137*b* form a narrow, deep groove therebetween and this is used to insert a loop of the edge of such wrapping material 51*a* therein followed by the insertion of a length of a larger diameter rope of rubberized material 51*b*, called a "spline", to jam in the groove and hold the loop in the groove thus allowing the sealing features of the wrap to extend along the entire length of the jamb.

Figure 8:
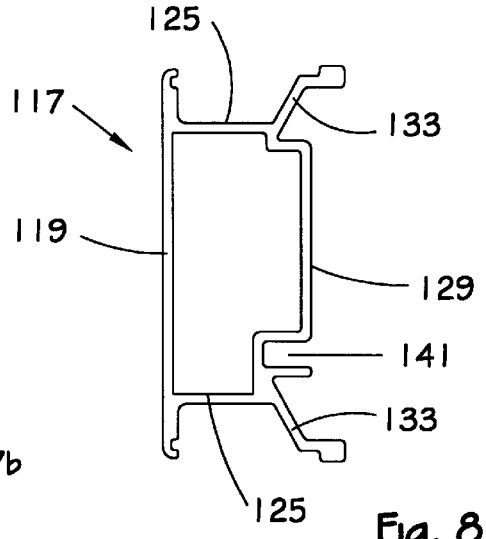
FIG. 8 is a cross-sectional view of another side member used in the side jamb section.

Front wall 119 is made thick for the purpose of receiving thereagainst the side frame member of one panel of plurality panels 7 that will abut assembled side frame element 5 and support a clasp-type lock (not shown) to secure the temporary assembly. Generally, only one panel is designed to close against side frame element 5 and the design includes a series of abrupt elevation changes 141, as shown in FIGS. 7 and 14, in order to form a seal against wind and rain between a panel side frame member 13 and front wall 119. As shown in FIG. 8, other side guide members 117 have a flat, planar front wall 119*a* when designed not to have a panel frame abut thereagainst.

Figure 10:
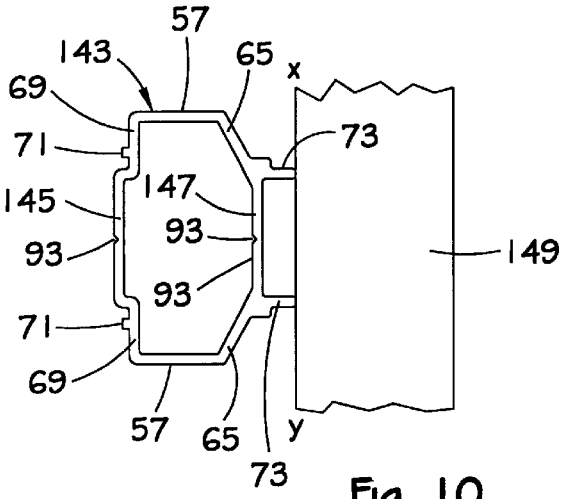
FIG. 10 is a cross-sectional view of a typical interior fascia member used in the side jamb section.

Spaced between successive side guide members 117 are separate elongated key spacer members 143 that are shown in FIG. 10 to have the same configuration and construction as spacer members 53 except that members 53 are rotated 90°, as shown in FIG. 10, such that while they comprise a hollow central body 55, defined by a pair of thin, spaced-apart side walls 57, top wall 59 is now a front wall 145 and bottom wall 61 is now rear wall 147 enclosing member 53 to form a similar hollow interior. The rear portions of side walls 57 are similarly formed into a pair of converging slanted walls 65 while the side portions of rear wall 147 are indented slightly at 69 and each indentation is provided with a forwardly extending stub 71. Along rear wall 147 are two spaced-apart ears 73 that extend rearward a short distance and terminate in edges 75 lying in a common plane x-y that abuts or mates with the outer surface of a beam 149 set behind the jamb for the purpose of providing support (see FIG. 10).

Rear wall 147, between ears 73, is made of a thickness sufficient for receipt therein of an adjustable shim 81 (not shown) that is used to adjust the distance of side guide member 117 from beam 149. Adjustable shim 81 is shown in FIG. 4.

Front wall 145 and rear wall 147 have small indentations 93 formed therein for locating a drill bit and for having an aperture drilled therein for insertion of Allen wrench 87. After use of Allen wrench 87 to adjust the assembled jamb against beam 77, wrench 87 is removed and an elongated fastener, such as a long screw 95, is inserted through the apertures and through hollow plug 85 and into beam 149 for fastening the assembled jamb to said beam just like that occurring with top jam assembly 3.

Figure 9:
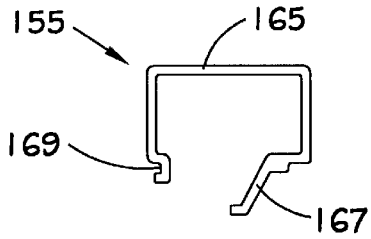
FIG. 9 is a cross-sectional view of a key spacer member used in the side jamb section.
Figure 11:
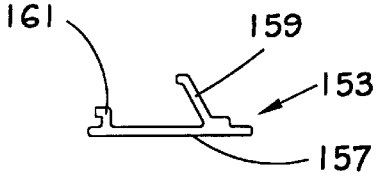
FIG. 11 is a cross-sectional view of a typical exterior fascia member used in the side jamb section.

Elongated, assembled side frame element 5 is terminated at both ends by separate inner and outer distal fascia ends, 153 and 155 respectively as shown in FIGS. 12 and 14. Inner distal fascia end 153 is shown in FIG. 11 to comprise an extrusion forming a flat, horizontally-oriented, main, interior fascia plate 157 having at least one slanted wall portion 159, extending away from plate 157 and adapted to interconnect to a slanted wall 133 of side guide member 117, and another element 161, spaced-apart from slanted wall portion 133 and extending outward for connection with interlocking terminus 123 on side guide member 117. Outer distal fascia end 155 is shown in FIG. 9 to comprise an extrusion forming a flat, vertically-oriented, main, exterior fascia plate 165 having at least one slanted wall portion 167, extending away from plate 165 and adapted to interconnect to a slanted wall 133 of side guide member 117, and another element 169, spaced-apart from slanted wall portion 167 and extending outward for connection with interlocking terminus 123 on side guide member 117.

In order to assemble and fix assembled top frame element 3 and assembled side frame element 5 in straight assemblies or rectilinear lineage, use is made of slanted walls 37, 65, 105, 111, 133, 159 and 167 in top frame element 3 and in side frame element 5. Once assembled, guide members and spacer members are inter-attached by interlocking terminus 27 and 123, and slanted side walls 37, 65, 105, 111, 133, 159 and 167 are in adjacent juxtaposition, as shown in FIGS. 12 through 15. Small apertures are formed (drilled) in these assembled slanted side walls and self-tapping screws 171 are threaded therein (see FIG. 13 for an example). The assembly of side walls 29 and side walls 57 in top guide member 19 and spacer member 51, in one planar direction, and the interlocking of stubs 71 and surned out interlocking terminus 27 along planes in other directions, and the assembly of slanted walls 37 and 65 in the same members, but in a plane located at an angle to the plane of slanted walls 37 and 65, insures that the assembled members take up a rectilinear assembly and remain straight before, during and after installation in the overall structure. The same practice also assures rectilinear assembly for the assembled side frame element. In practice, the size of the self-tapping screws in slanted walls 37 and 65 are set to lie below edges 75 and not interfere with positioning against beams 77 and 149.

Figure 16:
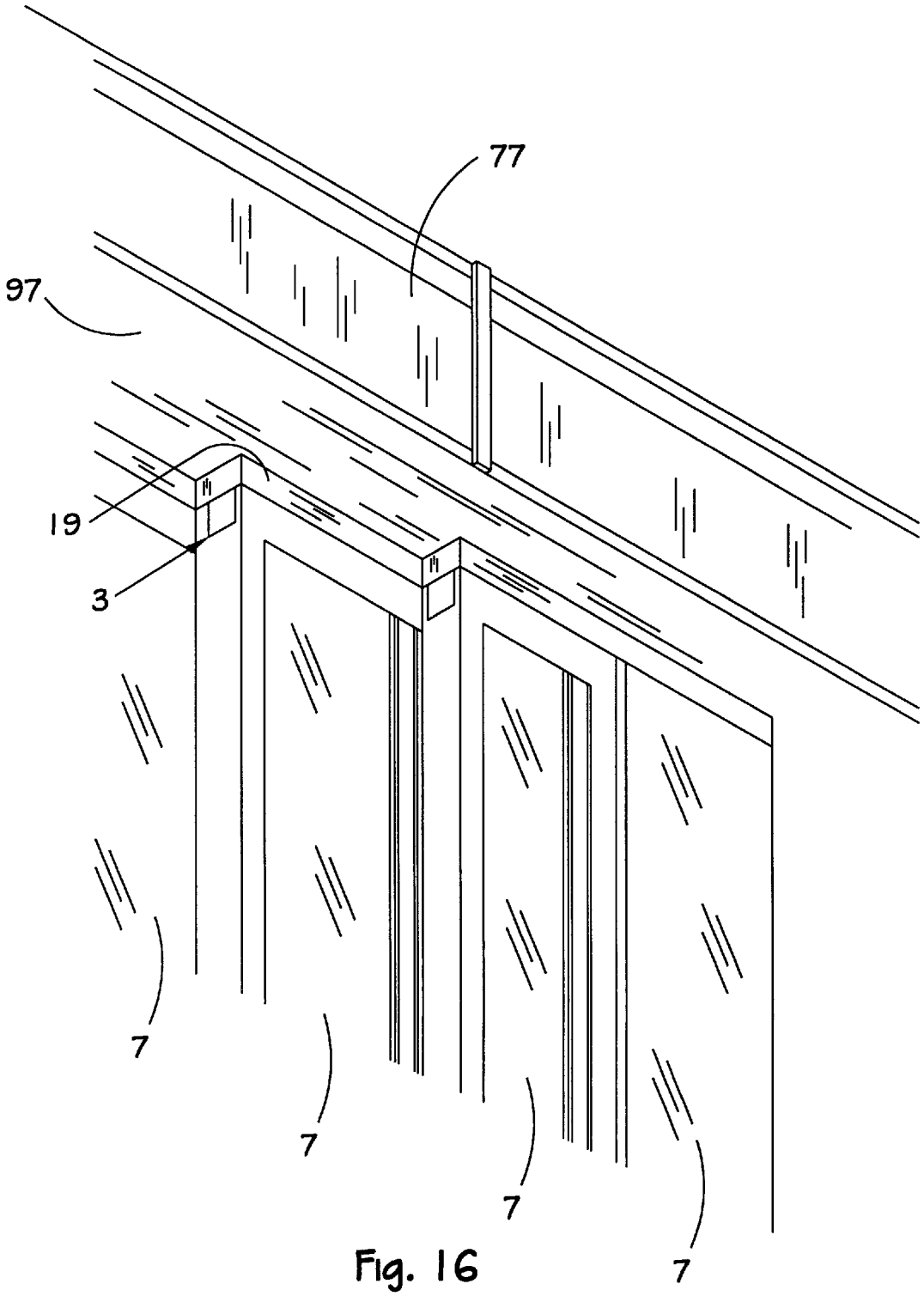
FIG. 16 is a perspective view of an assembled top jamb section that has the inner distal fascia end segmented to close off the lengths of the top guide member as needed.

As shown in FIG. 16, assembled top frame element 3 may be modified to reduce the length of top guide members 19 only to the lengths each panel is designed to move within jamb system 1. This is accomplished by segmenting inner distal fascia end 97 and closing off the lengths of top guide member 19 as needed. In addition, an elongated stub 173 is formed on one spacer member 143, as shown in FIG. 14, that runs along assembled side frame element 5 for the purpose of being received in a slot (not shown) in a screen panel that may be used with the novel jamb system of this invention. Stub 171 permits a panel, having a screen in place of glass subpanel 15, to run along the tracks at the base of the frame (not shown) and seal against assembled side frame element 5 by having elongated stub 171 be received in the slot in the screen panel.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A jamb system for framing a plurality of panels, in which at least one said panel is arranged to slide by another said panel along a set of tracks mounted on a supporting surface, comprising:

a) an elongated top jamb of defined width and terminated by spaced-apart inner and outer distal ends, said jamb including one elongated top guide member for each said panel, each said member including an elongated rail depending therefrom for guiding a panel along its travel within said jamb; and, b) an elongated key spacer member for insertion between each pair of said top guide member for spacing said adjacent top guide members apart a distance allowing said panels to move along said rails within said jamb past each other without interference;

c) said top guide members and said key members each formed of a plurality of side, top and bottom walls and including interlinking portions adapted to interlock through their respective walls to form a rectilinear assembly of a plurality of members for topping a plurality of doors and panels;

d) said top guide members and said key members including slanted wall portions arranged to mate in adjacent juxtaposition with each other and accept a threaded fastener therethrough to hold said jamb in fixed, straight alignment.

2. The jamb system of claim 1 further including an interior fascia plate at said interior distal end having at least one slanted wall portion adapted to interconnect to one of said top key members and further including a downwardly extending wall for preventing the influx of rain from the outside of the jamb interior thereof.

3. The jamb system of claim 1 further including an exterior fascia plate at said exterior distal end, having at least one slanted wall portion adapted to interconnect to said top key members and further including a downwardly extending stub.

4. The jamb system of claim 1 wherein said elongated rail, for guiding a panel along its travel within said jamb, contains a bifurcation for placement inside a portion of a panel.

5. The jamb system of claim 1 wherein each said elongated key spacer member comprises a central body and at least two, spaced-apart wall portions that extend upward from said central body and terminate along top edges that lie in a plane along with top edges from other key spacer members for abutment with a support beam set transverse to the length of said jamb and further including:

a) a first transverse wall located below said spaced-apart wall portions of a thickness for receipt therein of an adjustable shim; and, b) a second transverse wall, located below said first transverse wall and between said elongated rails depending from said top guide members;

c) said second transverse wall having formed therein an aperture to firstly accept the insertion of a tool therethrough to enter said adjustable shim and adjust the levelness of said elongated top jamb against said beam, and secondly to accept a fastener to fill said aperture and seize said adjustable shim against further, unwanted movement.

6. The jamb system of claim 1 further including:

a) a pair of closely spaced-apart upwardly directed walls extending upward from said top guide member and forming a narrow slot therebetween for insertion of a loop of thin sheet material forming vapor or other type barrier about the exterior of the structure in which said jamb is located; and, b) a length of flexible rope-like material for insertion inside said loop of thin sheet material to hold said material in said slot and against escape therefrom to seal said jamb about the periphery thereof.

7. A jamb system for framing a plurality of panels, in which at least one said panel is arranged to slide by another said panel along a set of tracks mounted on a supporting surface, comprising:

a) an elongated side jamb assembly of defined width and terminated by spaced-apart inner and outer distal ends, said jamb including one elongated side member for each said panel; and, b) an elongated key spacer member for insertion between each pair of said elongated side members for spacing said side members apart a distance allowing said panels to move along said rails within said jamb past each other without interference;

c) said elongated side members and said key members each formed of a plurality of side, top and bottom walls and including interlinking portions adapted to interlock through their respective walls to form a rectilinear assembly of a plurality of members for abutting a plurality of doors and panels;

d) said side members and said key members including slanted wall portions arranged to mate in adjacent juxtaposition with each other and accept a threaded fastener therethrough to hold said side jamb in fixed, straight alignment.

8. The jamb system of claim 7 further including an interior fascia plate at said interior distal end having at least one slanted wall portion adapted to interconnect to one of said side key members.

9. The jamb system of claim 7 further including an exterior fascia plate at said exterior distal end, having at least one slanted wall portion adapted to interconnect to said side key members.

10. The jamb system of claim 7 wherein each said elongated key spacer member comprises a central body and at least two, spaced-apart wall portions that extend outward from said central body and terminate along side edges that lie in a plane along with side edges from other key spacer members for abutment with a support beam set transverse to the length of said jamb and further including:

a) a first wall located transversely interior said spaced-apart wall portions of a thickness for receipt therein of an adjustable shim; and, b) a second transverse wall, located further interior said jamb from said first transverse wall;

c) said second transverse wall having formed therein an aperture to firstly accept the insertion of a tool therethrough to enter said adjustable shim and adjust the verticalness of said elongated side jamb against said beam, and secondly to accept a fastener to fill said aperture and seize said adjustable shim against further, unwanted movement.

11. The jamb system of claim 7 further including:

a) a pair of closely spaced-apart, outwardly-directed walls extending from said side guide member and forming a narrow slot therebetween for insertion of a loop of thin sheet material forming a vapor, or other type barrier, about the exterior of the structure in which said jamb is located; and, b) a length of flexible string-like material for insertion inside said loop of thin sheet material to hold said material in said slot and against escape therefrom to seal said jamb about the periphery thereof.

12. The jamb system of claim 7 further including a short elongated stub extending from said elongated side jamb toward said panels for receipt thereover of the edges of a screen panel.

13. A jamb system for framing a plurality of panels, in which at least one said panel is arranged to slide by another said panel along a set of tracks mounted on a supporting surface, comprising:

a) an elongated top jamb of defined width and terminated by spaced-apart inner and outer distal ends, said jamb including:

i) one elongated top guide member for each said panel, each said member including an elongated rail depending therefrom for guiding a panel along its travel within said jamb; and, ii) an elongated key spacer member for insertion between each pair of said top guide members for spacing said adjacent top guide members apart a distance allowing said panels to move along said rails within said jamb past each other without interference;

iii) said top guide members and said key members each formed of a plurality of side, top and bottom walls and including interlinking portions adapted to interlock through their respective walls to form a rectilinear assembly of a plurality of members for topping a plurality of doors and panels;

iv) said top guide members and said key members including slanted wall portions arranged to mate in adjacent juxtaposition with each other and accept a threaded fastener therethrough to hold said jamb in fixed, straight alignment; and, b) an elongated side jamb of defined width and terminated by spaced-apart inner and outer distal ends, said jamb including one elongated side member for each said panel; and, i) an elongated key spacer member for insertion between each pair of said elongated side members for spacing said side members apart a distance allowing said panels to move along said rails within said jamb past each other without interference;

ii) said elongated side members and said key members each formed of a plurality of side, top and bottom walls and including interlinking portions adapted to interlock through their respective walls to form a rectilinear assembly of a plurality of members for abutting a plurality of doors and panels;

iii) said side members and said key members including slanted wall portions arranged to mate in adjacent juxtaposition with each other and accept a threaded fastener therethrough to hold said side jamb in fixed, straight alignment;

c) said elongated top jamb and elongated side jamb joined together to form a complete frame about the top and sides of said panels.

14. The jamb system of claim 13 further including an interior fascia plate at said interior distal end of said top jamb having at least one slanted wall portion adapted to interconnect to one of said top key members and further including a downwardly extending wall for preventing the influx of rain from the outside of the jamb interior thereof.

15. The jamb system of claim 13 further including an exterior fascia plate at said exterior distal end of said top jamb, having at least one slanted wall portion adapted to interconnect to said top key members and further including a downwardly extending stub.

16. The jamb system of claim 13 wherein said elongated rail, for guiding a panel along its travel within said jamb, contains a bifurcation for placement inside a portion of a panel.

17. The jamb system of claim 13 wherein each said elongated key spacer member in said top jamb assembly comprises a central body with a hollow interior and at least two, spaced-apart wall portions that extend upward from said central body and terminate along top edges that lie in a plane along with said top edges from other key spacer members for abutment with a support beam set transverse to the length of said jamb and further including:

a) a first transverse wall located below said spaced-apart wall portions of a thickness for receipt therein of an adjustable shim; and, b) a second transverse wall, located below said first transverse wall and between said elongated rails depending from said top guide members;

c) said second transverse wall having formed therein an aperture to firstly accept the insertion of a tool therethrough to enter said adjustable shim and adjust the levelness of said elongated top jamb against said beam, and secondly to accept a fastener to fill said aperture and seize said adjustable shim against further, unwanted movement.

18. The novel jamb system of claim 13 further including:

a) a pair of closely spaced-apart, upwardly-directed walls extending from said top guide member and forming a narrow slot therebetween for insertion of a loop of thin sheet material forming a vapor or other type, barrier about the exterior of the structure in which said jamb is located; and, b) a length of flexible rope-like material for insertion inside said loop of thin sheet material to hold said material in said slot and against escape therefrom to seal said jamb about the periphery thereof.

19. The novel jamb system of claim 13 further including an interior fascia plate at said interior distal end of said side jamb having at least one slanted wall portion adapted to interconnect to one of said side key members.

20. The jamb system of claim 13 further including an exterior fascia plate at said exterior distal end of said side jamb, having at least one slanted wall portion adapted to interconnect to said side key members.

21. The jamb system of claim 13 wherein each said elongated key spacer member in said side jamb assembly comprises a central body and at least two, spaced-apart wall portions that extend outward from said central body and terminate along side edges that lie in a plane along with side edges from other key spacer members for abutment with a support beam set transverse to the length of said jamb and further including:

a) a first wall located transversely interior said spaced-apart wall portions of a thickness for receipt therein of an adjustable shim; and, b) a second transverse wall, located further interior said jamb from said first transverse wall;

c) said second transverse wall having formed therein an aperture to firstly accept the insertion of a tool therethrough to enter said adjustable shim and adjust the verticalness of said elongated side jamb against said beam, and secondly, to accept a fastener to fill said aperture and seize said adjustable shim against further, unwanted movement.

22. The jamb system of claim 13 further including:

a) a pair of closely spaced-apart, outwardly-directed walls extending from said side guide member and forming a narrow slot therebetween for insertion of a loop of thin sheet material forming a vapor, or other type, barrier about the exterior of the structure in which said jamb is located; and, b) a length of flexible rope-like material for insertion inside said loop of thin sheet material to hold said material in said slot and against escape therefrom to seal said jamb about the periphery thereof.

23. The jamb system of claim 13 further including a short elongated stub extending from said elongated side jamb toward said panels for receipt thereover of the edges of a screen panel.

24. An elongated, extruded, hollow-top guide member for assembly with other members to form a jamb system for framing a plurality of panels, in which at least one said panel is arranged to slide by another said panel along a set of tracks mounted on a supporting surface, wherein said top guide member comprises:

a) a planar bottom wall terminated by spaced-apart bottom wall edges wherein said bottom wall edges are formed into a turned-out interlocking terminus;

b) a pair of spaced-apart side walls extending upward from said bottom wall in parallel arrangement and interior of said bottom wall turned-out edges;

c) a top wall parallel to said bottom wall and spaced-apart thereabove and closing said top guide member between said side walls to form a hollow interior;

d) a pair of slanted walls extending upward and outward from an area on said member between said top wall and its junction with said side walls, said slanted walls terminating in a bent-outward configuration; and, e) an elongated rail depending from said planar bottom wall, exterior said hollow interior, and extending parallel to said side walls for guiding a panel along its travel within said jamb.

25. An elongated, extruded, hollow-top key member for assembly with other members to form a jamb system for framing a plurality of panels, in which at least one said panel is arranged to slide by another said panel along a set of tracks mounted on a supporting surface, wherein said top key member comprises:

a) a planar bottom center wall bounded by a pair of spaced-apart, parallel, bottom, outside walls set slightly above said planar, bottom, center wall and terminating in a pair of spaced-apart, parallel outside wall edges;

b) a pair of spaced-apart side walls extending vertically upward from said spaced-apart, parallel outside wall edges;

c) said spaced-apart side walls departing from a vertically upward direction, a portion of the way up said side wall, and forming a pair of converging slanted walls terminating in a top wall parallel to and spaced-above said bottom center wall to form a hollow interior; and, d) at least two, spaced-apart wall portions that extend upward from said central body and terminate along said top edges that lie in a plane along with said top edges from other assembled key spacer members for abutment with a support beam set transverse to the length of said jamb.

* * * * *